US006088963A

United States Patent [19]

Cawthon et al.

[11] Patent Number: 6,088,963

[45] Date of Patent: Jul. 18, 2000

[54] AUTOMOTIVE BAY PIT COVER WITH PANELS HAVING TAPERED ENDS FOR VERTICAL STACKING

[76] Inventors: Mark C. Cawthon, 328 Kings Canyon; Ken A. Miller, 2122 Edinburg Dr., both of Yukon, Okla. 73099

[21] Appl. No.: 08/920,092

[22] Filed: Aug. 26, 1997

[51] Int. Cl.[7] ..... E06B 11/00; E05D 15/26

[52] U.S. Cl. ..... 49/33; 49/125; 49/127

[58] Field of Search ..... 49/33, 125, 127, 49/128; 137/234.6; 52/780

[56] References Cited

U.S. PATENT DOCUMENTS

| | | | |
|---|---|---|---|
| 763,493 | 6/1904 | Lacey | 160/118 |
| 1,636,806 | 7/1927 | Campbell | 49/128 |
| 2,189,389 | 2/1940 | Baker . | |
| 2,223,023 | 11/1940 | Weilemann | 220/345.5 |
| 2,317,686 | 4/1943 | Kuyper | 160/101 |
| 3,208,809 | 9/1965 | Quimper . | |
| 3,694,959 | 10/1972 | Gartner | 49/128 |
| 4,616,451 | 10/1986 | Glick . | |
| 4,644,690 | 2/1987 | Caimi | 49/130 |
| 4,762,242 | 8/1988 | Harris et al. . | |
| 4,960,150 | 10/1990 | Ryan . | |
| 5,167,341 | 12/1992 | Morton et al. . | |
| 5,189,836 | 3/1993 | Alder et al. | 49/33 |
| 5,636,483 | 6/1997 | Klager | 52/165 |

OTHER PUBLICATIONS

Brochure, BayNets Safety Systems, 135 Wood Rd., Braintree, MA 02184 (no date).

Brochure , Universal Safety Covers, "PIT GUARD"™ (no date).

SAF–T–NET™ Brochure, Universal Safety Covers, Inc., 3211 Avenue E East, Arlington, TX 76011 (no date).

Brochure, Devon Industries, P.O. Box 270514, Oklahoma City, OK 73137 (no date).

*Primary Examiner*—Daniel P. Stodola
*Assistant Examiner*—Gregory J. Strimbu
*Attorney, Agent, or Firm*—Head, Johnson, & Kachisian

[57] ABSTRACT

A retractable cover for an opening of an automotive bay pit wherein the retractable cover is formed by movable and stackable panels. The panels are normally positioned adjacent one another. Each panel includes supporting and spanning edges. Positioned on the supporting edges are slide rails. The slide rails are slidable in two horizontal directions in tracks of the automotive bay pit. The ends of the slide rails are inclined, and abutting ends of the slide rails of adjacent panels are parallel to one another. Because the abutting ends are parallel, an operator's application of a strictly horizontal force to a panel causes the panel to wedge under or slide over an adjacent panel. Therefore, the operator is not required to apply any vertical lifting force to a panel to create an opening in the cover. The operator may move any panel in the cover and move it in either horizontal direction to create the opening in the cover.

1 Claim, 3 Drawing Sheets

AUTOMOTIVE BAY PIT COVER WITH PANELS HAVING TAPERED ENDS FOR VERTICAL STACKING

BACKGROUND OF THE INVENTION

1. Field of the Invention

The present invention relates to a cover for an opening. More particularly, the present invention relates to a movable cover for covering an automotive bay pit, wherein the movable cover has a plurality of panels placed adjacently to one another.

2. Background Art

Automotive service centers are typically provided with one or more service pits. A typical service pit is an opening approximately three feet wide by seventeen feet long. Automobiles or other vehicles are driven over the automotive bay pit for servicing. A pit may be up to eight feet deep and provides an area for a mechanic to stand and access the underside of a vehicle by reaching up through the pit opening.

Automotive bay pits are inherently dangerous to both employees and customers of an automotive service center because of the likelihood of serious injury or death if a person inadvertently steps into the opening of the automotive bay pit. An additional opportunity for serious injury exists if a vehicle tire is inadvertently directed over the pit opening when an operator is attempting to straddle the pit with the vehicle. Instances of workers accidentally stepping into an automotive bay pit are not uncommon since portions of the automotive bay pit remain uncovered by a vehicle when a vehicle is straddling the pit to be serviced. Often, a worker forgets that a portion of the open automotive bay pit extends beyond the front or rear of the vehicle. Therefore, it is not uncommon for injury to occur when a worker attempts to walk either in front of or behind a vehicle to get around the vehicle.

Consequently, it is desirable to provide a retractable automotive bay pit cover that allows access to the underside of a vehicle and that may be used to cover the automotive bay pit to prevent accidents. The desirability of such a cover is recognized in OSHA 1910.23-Guarded Floor Openings.

Previously, attempts have been made to provide movable, or retractable, covers for automotive bay pits. Insofar as applicant is aware, known pit covers have generally been of two types. A first type is made of a retractable net or mesh material that may be opened to allow access to the underside of a vehicle or closed to prevent persons from falling into the pit area. A disadvantage with net-type pit covers is that netting or mesh materials are unstable and may cause an unwary individual who steps on the material to trip and fall. An additional disadvantage of the net-type systems is that the net or mesh must be opened from one end to access a vehicle. Therefore, more of the bay pit is open or exposed than just the portion necessary for access to a vehicle.

A second type of known bay pit cover is provided in the form of a plurality of panels. Although the provision of a plurality of rigid panels eliminates the disadvantages of an unstable surface for use in covering an automotive bay pit, there exist other disadvantages with such covers. Insofar as applicant is aware, known multi-panel bay pit covers are generally of two types. A first type utilizes a plurality of interconnected panels wherein the panels are on rollers and are designed to retract and stack directly above one another. Such a system is described in U.S. Pat. No. 4,762,242. A disadvantage with an interconnected retractable cover system is, similar to that of the net or mesh design, that the covers must be retracted from one end, thereby exposing more of the pit opening than is necessary.

A second type of pit cover utilizing a plurality of panels utilizes multiple, unconnected panels placed over the length of the pit opening. Such a system is described in U.S. Pat. No. 4,960,150. Known pit covers of this type utilize individual panels having rollers affixed thereto. In operation, a mechanic must lift a panel and then roll it over an adjacent panel to create an opening. A difficulty with such a design is that a worker must lift the panel before the panel may be stacked on an adjacent panel. This difficulty is compounded when it is desired to remove two or more panels to open a wider area. To access such an area, an operator or mechanic must lift the second panel high enough to clear the resulting stack of two or more panels. An additional difficulty with such a system is that when the resulting stack of two or more panels is positioned at a location either to the front or to the rear of a vehicle, the panels present a hazard to any worker stepping on the stack since the stacked panels contact one another via rollers.

SUMMARY OF THE INVENTION

One object of the present invention is to provide an automotive pit bay cover that will support a man or vehicle for preventing injuries sustained by falling into or around the pit.

Another object of the present invention is to provide an automotive bay pit cover that allows a mechanic to easily access the underside of a vehicle at any desired location.

Yet another object of the invention is to provide a cover system wherein a mechanic is not required to lift panels over adjacent panels to access a vehicle.

An additional object is to provide a user-friendly cover system whereby an operator may quickly and easily open the entire automotive bay pit without the necessity for lifting each individual panel.

The present invention is a movable or retractable cover for covering an opening such as a typical automotive bay pit wherein the pit possesses a pair of longitudinal tracks. The retractable cover includes at least a pair of panels, and preferably a plurality of panels, each placed adjacent to one another within the tracks bordering the opening of the automotive bay pit. Each panel has a right supporting edge for engaging a track on the right side of the opening, and a left supporting edge for engaging a track on the left side of the opening. Additionally, each panel possesses a forward spanning edge and a rearward spanning edge, each spanning the pit opening. Positioned on the right and left supporting edges of the panels are slide rails. The slide rails are preferably formed of a synthetic friction-reducing material such as nylon. The slide rails enable an operator to easily slide a selected panel within the longitudinal tracks of the automotive bay pit cover.

The panels are designed to be positioned adjacent one another within the opening of the automotive bay pit. Each slide rail affixed to the panels has a tapered forward end and a tapered rearward end. When the automotive bay pit is substantially covered by the panels, the rearward ends of the slide rails of a first panel will be closely adjacent the forward ends of the slide rails of a second panel. The forward tapered ends of the slide rails should complement the rearward tapered ends of an adjacent panel. That is, for example, if the rearward ends of the slide rails of a first panel are tapered such that the terminal surfaces of the rearward ends of the slide rails form an acute angle with respect to the upper surface of the slide rail and an obtuse angle with respect to the lower surface of the slide rail, then the terminal surfaces of the forward end of the slide rails of a second or adjacent panel should form an acute angle with respect to the bottom surface of the slide rail and an obtuse angle with respect to the top surface of the slide rail. Therefore, when an operator desires to open an area of the pit for access to a vehicle, the first panel may be grasped and shoved rearward, which results in the first panel sliding over the second panel and easily moving into place, thereby creating an opening at a desired location.

Alternatively, an operator may grasp the second panel and slide it in the direction of the first panel. Because the lower surface and terminal surface of the slide rail on the second panel form an acute angle or a point proximate the lower surface of the slide rail, the second panel easily wedges under the first panel and may be slid under the first panel to create an opening through which an operator may access the underside of a vehicle.

Of course, the orientation of a particular tapered end of a slide rail is not important, so long as adjacent ends of adjacent panels complement one another.

Therefore, it can be seen that the provision of multiple panels having slide rails with adjacent tapered ends, wherein the tapered ends complement one another, allows an operator to select any panel and slide the panel in either direction to create an opening. The selected panel is designed to easily slide over or wedge under an adjacent panel. This eliminates the need for an operator to lift a selected panel over adjacent panels. Additionally, panels that are not proximate a desired opening, such as panels to the front or rear of a vehicle, may be left in place thereby providing a safe work area and surface. Any stacked panels resulting from a created opening also provide a safe surface for stepping, since the panels do not engage one another via rollers.

DETAILED DESCRIPTION OF THE PREFERRED EMBODIMENTS

Figure 1:
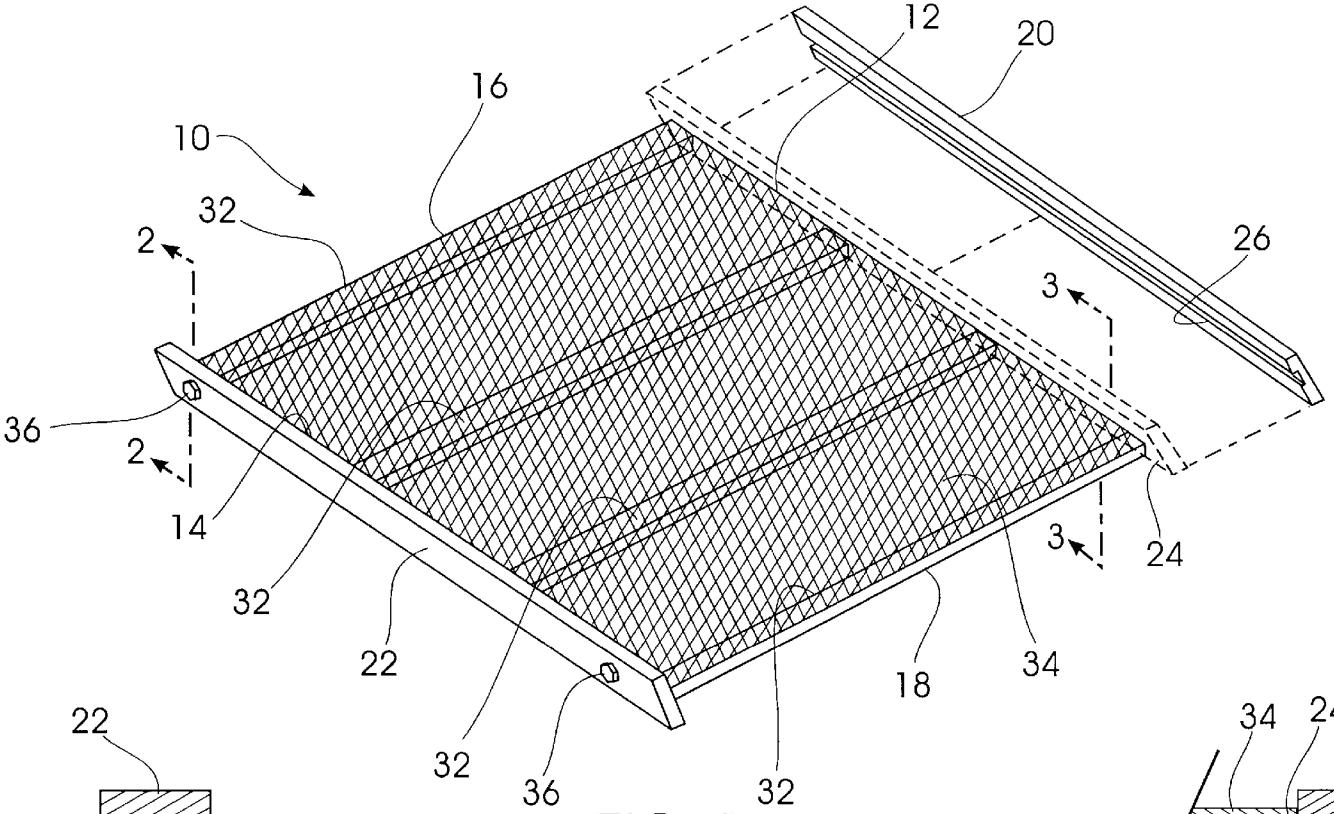
FIG. 1 is a partially exploded perspective view of a panel of the present invention.

Referring now to FIG. 1, shown is a panel, designated generally 10, for use in a retractable cover for an opening. Panel 10 has a right supporting edge 12, a left supporting edge 14, a forward spanning edge 16 and a rearward spanning edge 18. Right supporting edge 12 and left supporting edge 14 may be of any appropriate length such that a plurality of panels 10 placed adjacent one another will fully cover the length of an opening, such as an automotive bay pit. Similarly, forward spanning edge 16 and rearward spanning edge 18 may be of any width necessary to span an opening.

Affixed to right supporting edge 12 is right slide rail 20. Affixed to left supporting edge 14 is left slide rail 22. In the preferred embodiment, each of right supporting edge 12 and left supporting edge 14 has a longitudinal strip of angle iron 24, such as is visible on right supporting edge 12 in FIG. 1. Preferably, right slide rail 20 and left slide rail 22 each has a longitudinal groove 26 formed thereon as is visible on right slide rail 20 of FIG. 1. Longitudinal groove 26 is for receiving horizontal plane 28 of longitudinal angle iron 24.

Figure 3:
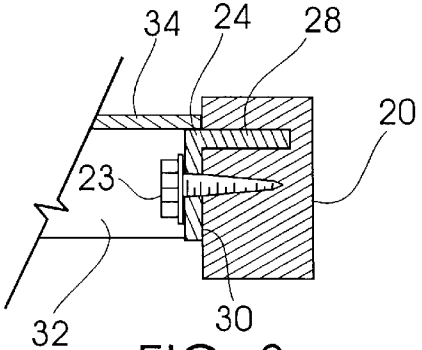
FIG. 3 is a cross-sectional view taken along line 3—3 of FIG. 1 showing the preferred interconnection of a slide rail and a supporting edge of the panel.

For the preferred embodiment shown in FIGS. 1 and 3, slide rail 20 is affixed to longitudinal angle iron 24 by three screws 23 which pass through the vertical plane 30 of longitudinal angle iron 24. The three screws 23 are installed through the angle iron 24 in such a manner that threaded ends of the three screws 23 are pointing outwardly with respect to the panel 10. Although not visible in FIGS. 1 and 3, there is an analogous structure for attaching slide rail 22 to another longitudinal angle iron using three screws. However, other means of securing slide rails 20 and 22 may be used. It is preferred that slide rails 20 and 22 are removably secured to panel 10 so that slide rails 20 and 22 may be replaced if they become worn or damaged.

The longitudinal angle irons positioned on right supporting edge 12 and left supporting edge 14 are preferably connected together by cross members 32. Preferably, equally spaced 1½ inch × ¾ inch 14-gauge tubing is used for cross members 32. In the preferred embodiment, panel cover 34 is supported by cross members 32. Preferably, panel cover 34 is formed from ¾ inch × 9–11 expanded metal. Expanded metal is preferred since expanded metal helps to reduce the weight of panel 10 and additionally allows light to pass through panel 10. However, other materials may be used to form panel cover 34.

Figure 2:
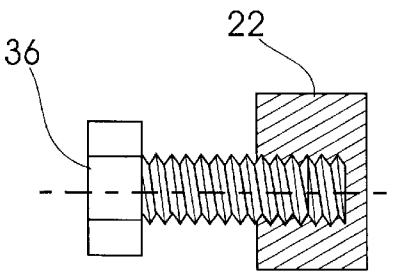
FIG. 2 is a cross-sectional view along line 2—2 of FIG. 1 showing an adjustable bolt.

Since pit openings are not of a standard width, it is desirable to provide a means to adjust the effective width of panel 10. Adjusting bolts 36 are provided to engage one or both of slide rails 20 and 22. The adjusting bolt is designed to engage a surface of the automotive pit bay opening, thereby maintaining right slide rail 20 and left slide rail 22 a predetermined distance from the surface of the pit bay opening. In the preferred embodiment, adjusting bolts 36 are black nylon and are positioned proximate either end of right slide rail 20 and left slide rail 22. Adjusting bolt 36 can be more clearly seen in FIG. 2. By utilizing black nylon to form adjusting bolt 36, friction with an outer surface of the opening is reduced.

Figure 4:
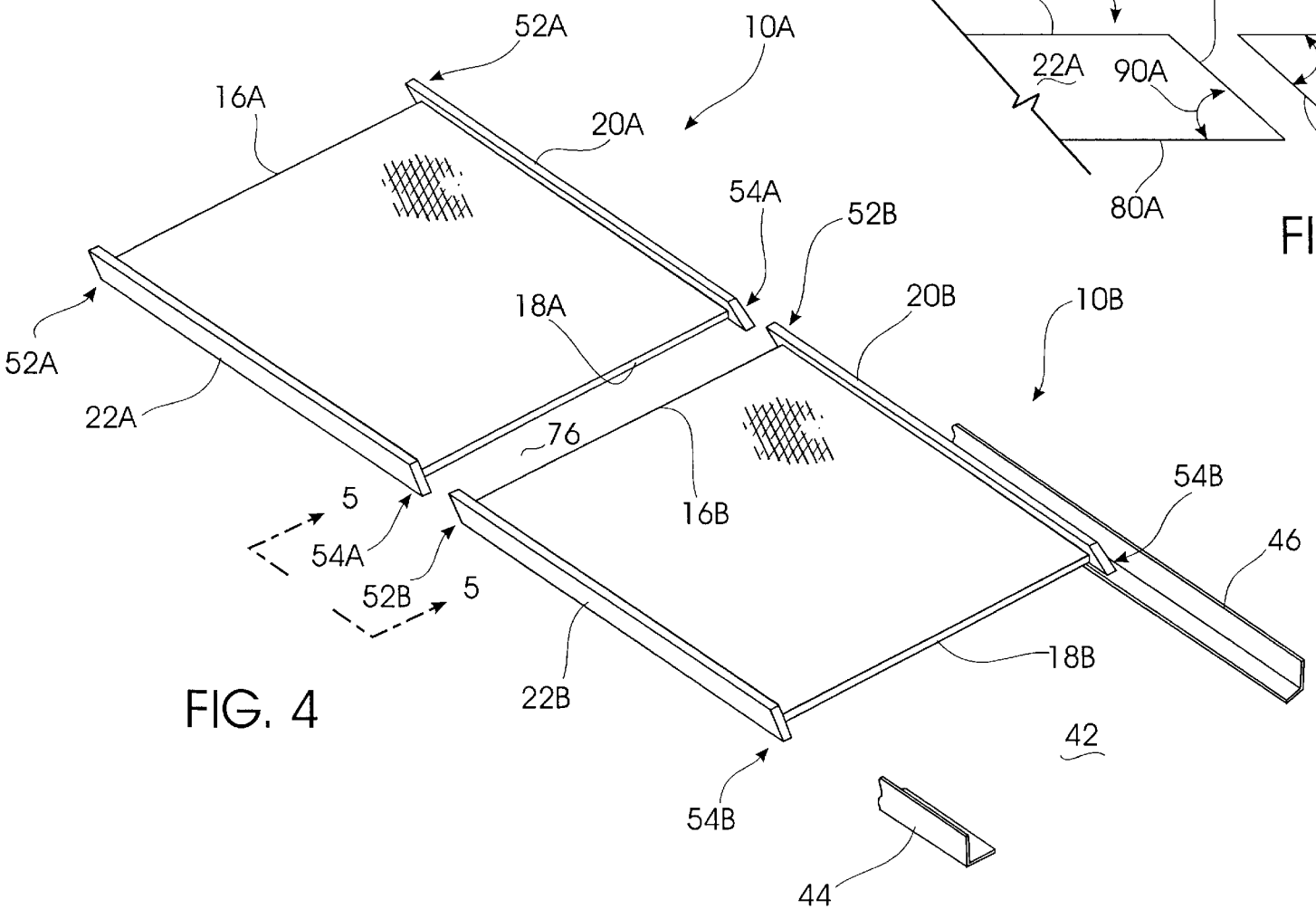
FIG. 4 is a perspective view of a pair of panels positioned within the tracks of a typical pit opening.

Referring now to FIG. 4, a perspective view of a first panel 10A and a second panel 10B is shown positioned within opening 42. Opening 42 is bordered by outer surface or left longitudinal track 44 and outer surface or right longitudinal track 46. First panel 10A possesses right first slide rail 20A and left first slide rail 22A. Right first slide rail 20A and left first slide rail 22A each possess a tapered forward end 52A and a tapered rearward end 54A. Additionally, first panel 10A possesses first forward spanning edge 16A and first rearward spanning edge 18A. Second panel 10B has right second slide rail 20B and left second slide rail 22B affixed thereto. Right second slide rail 20B and left second slide rail 22B each possess a tapered forward end 52B and a tapered rearward end 54B. Second panel 10B further includes second forward spanning edge 16B and second rearward spanning edge 18B.

It is noted that when second forward tapered ends 52B are adjacent to first tapered rearward end 54A, second forward spanning edge 16B is not in contact with first rearward spanning edge 18A. Instead, between second forward spanning edge 16B and first rearward spanning edge 18A is gap 76. Gap 76 is provided so that an operator may easily grasp any forward or rearward spanning edge to move a selected panel. Additionally, by providing gap 76, an operator need not be concerned about smashing his fingers between any spanning edges.

Figure 5:
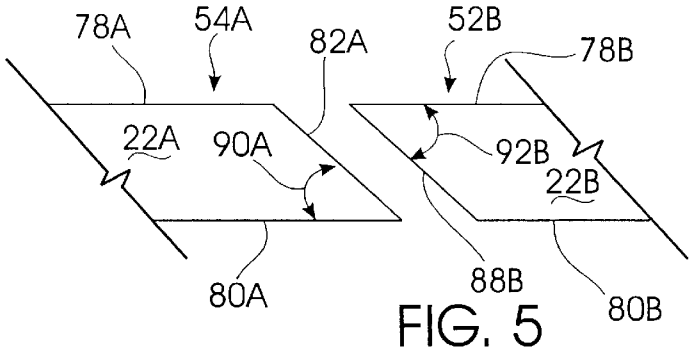
FIG. 5 is an elevation view taken along line 5—5 of FIG. 4 of a rearward tapered end of a first left slide rail adjacent a complementing forward tapered end of a second left slide rail.

Referring now to FIG. 5, an enlargement of the interface between first tapered rearward end 54A and second tapered forward end 52B is shown. Left first slide rail 22A has upper surface 78A, lower surface 80A and terminal surface 82A. Additionally, left second slide rail 22B includes upper surface 78B, lower surface 80B and terminal surface 88B. It is noted that terminal surface 82A of left first slide rail 22A forms acute angle 90A at the intersection of terminal surface 82A and lower surface 80A. In contrast, terminal surface 88B of left second slide rail 22B forms acute angle 92B between terminal surface 88B and upper surface 78B. Therefore, first tapered rearward end 54A complements second tapered forward end 52B. In the preferred embodiments, acute angles 90A and 92B are 30°. Although angles between approximately 45° and 70° have been found to be most effective, slide rails having tapered ends of any angle that will permit adjacent panels to engage and slidably surmount or slidably wedge under one another may be used. As also seen in FIG. 5, the first tapered rearward end 54A and the second tapered forward end 52B are inclined to the vertical and are substantially parallel. Accordingly, the tapered rearward terminal surface 82A and tapered forward terminal surface 88B are also inclined to the vertical and are substantially parallel to one another.

As a result of complementing tapered ends 54A and 52B, if an operator slides first panel 10A in the direction of second panel 10B, which are both shown in FIG. 4, first panel 10A will slidably engage and wedge under second panel 10B to create an opening through which the operator can access the underside of a vehicle. Conversely, if an operator grasps second panel 10B and slides second panel 10B in the direction of first panel 10A, then the second panel 40 will slidably engage and surmount the first panel 10A to create an opening. When the panels are stacked, the slide rails of a particular panel are in intimate contact with the slide rails of another panel above or below that particular panel. It should be understood that in the preferred embodiment, opening 42 is covered by a plurality of panels similar to first panel 10A and second panel 10B. Each of the panels is provided with complementing tapered ends with respect to an adjacent panel. Consequently, an operator may select any of the panels and slide the selected panel in either direction to create an opening at any desired location.

Additionally, an operator may select a panel at either end of opening 42 and slide that panel the length of opening 42, thereby creating a stack of panels that have slid over or wedged under adjacent panels.

Figure 6:
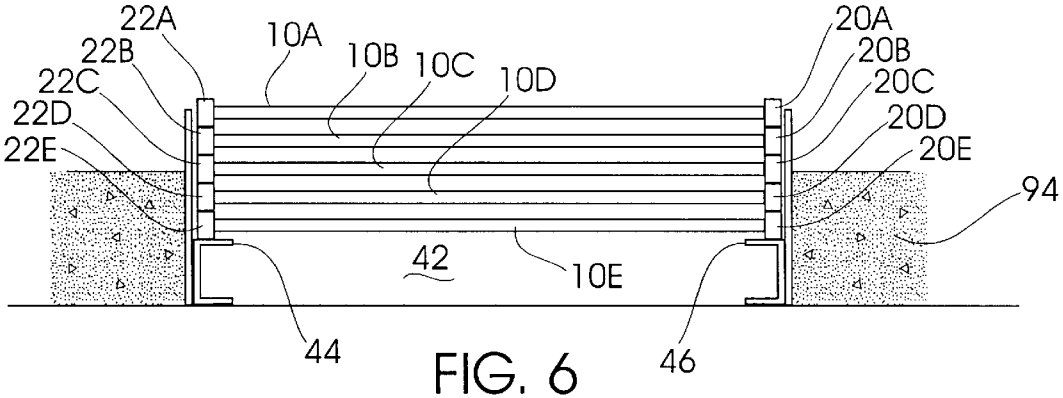
FIG. 6 is an end view of an automotive pit cover having a plurality of panels stacked one on top of another.

Referring now to FIG. 6, shown is a stack of panels 10 which have been stacked one on top of another to maximize opening 42 for creating a work area for an operator. It is noted that right slide rails 20A, 20B, 20C, 20D and 20E and left slide rails 22A, 22B, 22C, 22D, AND 22e, affixed to their respective panels, are positioned one on top of the other. Right slide rails 20A, 20B, 20C, 20D, and 20E and left slide 22A, 22B, 22C, 22D, and 22E slide easily over left longitudinal track 44 and right longitudinal track 46. However, right slide rails 22A, 22B, 22C, 22D, and 22E and left slide rails 22A, 22B, 22C, 22D, and 22E do not result in a nearly frictionless surface when stacked together. Therefore, an operator may step onto the stack of panels without the likelihood of falling that is associated with panels having rollers on their upper and lower surfaces which can create a "rollerskate effect" and a hazard to an operator.

Since the panels of the invention do not have rollers, panels 10A, 10B, 10C, 10D, and 10E have a low profile, as can be seen in FIG. 6. The low profile of the panels results in a low clearance height with respect to floor 94 so that multiple panels 10A, 10B, 10C, 10D, and 10E may be stacked on top of one another without contacting the bottom of a vehicle. Additionally, the absence of rollers or other complicated engagement means between the panels results in a panel that is light and easy to manipulate by an operator. It is desirable to construct panels 10A, 10B, 10C, 10D, and 10E to support the weight of a vehicle was distributed over a tire footprint, typically about 1000 lbs. Even so, Applicants have found that panels of sufficient strength may be constructed in accordance with the present invention that have a weight of less than 10 lbs. per linear foot.

Figure 7:
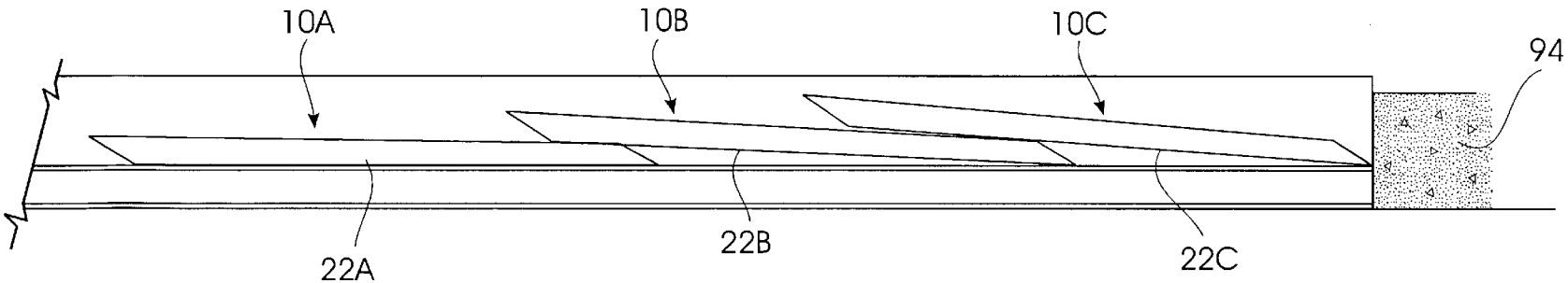
FIG. 7 is a side view of a plurality of panels partially stacked one on top of another.

FIG. 7 shows slide rails 22A, 22B and 22C of first panel 10A, second panel 10B, and third panel 10C, respectively. FIG. 7 is provided to illustrate that adjacent panels, such as panels 10A, 10B and 10C may be positioned partially one on top of another by an operator to create an opening through which the operator may gain access to a vehicle.

Whereas, the present invention has been described in relation to the drawings attached hereto, it should be understood that other and further modifications, apart from those shown or suggested herein, may be made within the spirit and scope of this invention.

What is claimed is:

1. A cover for an opening of an automotive bay pit having a pair of longitudinal tracks, said cover comprising at least a first panel and a second panel, each of said panels comprising:

(a) a right supporting edge having a right slide rail affixed thereto, said right slide rail having an upper surface and a lower surface, a first tapered end that tapers to a point proximate one of said upper surface and said lower surface, a second tapered end that tapers to a point proximate the other of said upper surface and said lower surface, a strip of angle iron, and a slot, wherein said strip of angle iron is received in said slot;

(b) a left supporting edge having a left slide rail affixed thereto, said left slide rail having an upper surface and a lower surface, a first tapered end that tapers to a point proximate one of said upper surface and said lower surface, a second tapered end that tapers to a point proximate the other of said upper surface and said lower surface, a strip of angle iron, and a slot, wherein said strip of angle iron is received in said slot;

(c) at least two cross members spanning from said right supporting edge to said left supporting edge;

(d) a panel cover supported by said cross members; and (e) each of said slide rails being adapted for slidable engagement with the tracks;

wherein said tapered ends of said slide rails of said first panel complement said tapered ends of said slide rails of said second panel, wherein said first tapered ends of said slide rails of said first panel, upon application of a first horizontal force to said first panel, in the direction of said second panel, slidably engage and wedge under said second tapered ends of said slide rails of said second panel and wherein said second tapered ends of said slide rails of said second panel, upon application of a second horizontal force to said second panel in the direction of said first panel, slidably engage and surmount said first tapered ends of said slide rails of said first panel.

* * * * *